US005769042A

United States Patent [19]

Popadiuc

[11] Patent Number: 5,769,042

[45] Date of Patent: Jun. 23, 1998

[54] METHOD OF OPERATING AN INTERNAL COMBUSTION ENGINE DURING A COMBUSTION PROCESS

[76] Inventor: Ovidiu Petru Popadiuc, 542 Charles St., Windsor On., Canada, N8X 3G3

[21] Appl. No.: 558,400

[22] Filed: Nov. 16, 1995

Related U.S. Application Data

[63] Continuation-in-part of Ser. No. 427,848, Apr. 26, 1995, abandoned.

[51] Int. Cl.[6] ..... F02B 75/04

[52] U.S. Cl. ..... 123/78 B

[58] Field of Search ..... 123/78 B, 78 A, 123/78 RA, 48 A, 48 AA, 48 B

[56] References Cited

U.S. PATENT DOCUMENTS

| | | | |
|---|---|---|---|
| 560,918 | 5/1896 | Oderman | 123/78 B |
| 1,825,163 | 9/1931 | Schweter | 123/78 B |
| 2,170,266 | 8/1939 | Leissner | 123/78 B |
| 2,323,742 | 7/1943 | Webster . | |
| 3,042,008 | 7/1962 | Liesse | 123/48 A |
| 4,078,450 | 3/1978 | Vallejos . | |
| 4,137,873 | 2/1979 | Caswell, Sr. | 123/78 B |
| 4,359,976 | 11/1982 | Steele | 123/78 B |
| 4,469,055 | 9/1984 | Caswell | 123/78 B |
| 4,510,895 | 4/1985 | Slee | 123/49 B |
| 5,191,863 | 3/1993 | Hagiwara . | |

OTHER PUBLICATIONS

Internal Combustion Engines, Rowland S. Benson and N.D. Whitehouse, Pergamon Press.

*Primary Examiner*—Marguerite McMahon
*Attorney, Agent, or Firm*—Lowe Price LeBlanc & Becker; Reising, Ethington, Barnard & Perry, PLLC

[57] ABSTRACT

The present application relates to a method of operating an internal combustion engine during combustion process that makes it possible to breake the increase of the gas pressure at the beginning of combustion, and partially to replace it by a lengthened substantially isobaric process, i.e., a process in which the combustion pressure keeps nearly steady. In this way, the combustion rate and the variation of the combustion chamber in volume can be optimally synchronized for improving the engine operation.

8 Claims, 8 Drawing Sheets

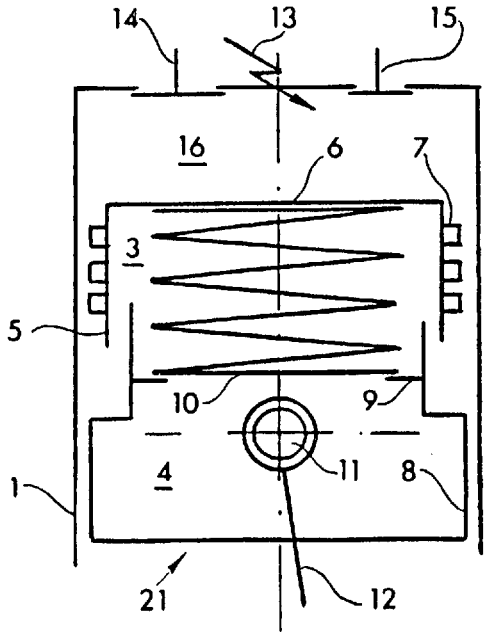
Fig. 2a
Fig. 2
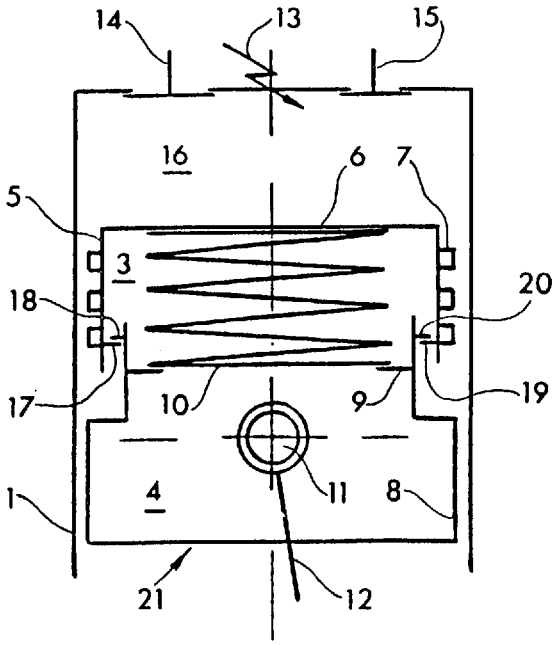
Fig. 2b

METHOD OF OPERATING AN INTERNAL COMBUSTION ENGINE DURING A COMBUSTION PROCESS

CROSS-REFERENCE

The present application is a continuation-in-part of the application Ser. No. 08/427,848 filed 26 Apr. 1995, now abandoned entitled "Method for Increasing the Thermal Efficiency of the Internal Combustion Engines", currently pending.

FIELD OF THE INVENTION

The present invention relates to a method of operating an internal combustion engine for keeping al least partially a quasi-isobaric process during combustion, i.e., a process in which the combustion pressure keeps nearly steady.

BACKGROUND OF THE INVENTION

As shown in FIG. 1, the Otto, dual combustion and Diesel cycles which are superimposed for the same maximum pressure and work done, have their thermodynamic efficiencies ($\eta_t$) in the following relation:

$$\eta_{t\ Diesel\ cycle} > \eta_{t\ dual\ combustion\ cycle} > \eta_{t\ Otto\ cycle}$$

It is known that to achieve a thermodynamic cycle in an internal combustion engine, the volume of the space which contains the working fluid must be varied according to a proper variation law. In most of the present day engines, the variation law of the above-mentioned volume is determined by the crank mechanism movement. In an engine working chamber, the increase in pressure and temperature rate during combustion depends not only on the combustion rate but also on the speed of the working chamber variation in volume.

In the engines as they are now, the volume variation of the working chamber does not depend on the pressure and temperature rate of change. It is desirable that at least during combustion, the variation of the combustion chamber in volume be dependent on the increase in gas pressure. If this objective is accomplished, then the variation of the work volume can be optimally correlated with combustion speed, so as to allow an increase in compression ratio of the engine and at the same time to brake the increase of the gas pressure at the beginning of combustion and partially to replace it by a lengthened substantially isobaric process.

In a typical high pressure combustion engine, if the combustion is violent and the increase of the combustion chamber volume is too slow, the mechanical and thermal engine's superstresses generated by the high pressure and temperature can deteriorate or even destroy the active elements of the engine. Detonation, generally the rapid combustion at approximate constant volume, is typical for this situation.

In the past, several devices were invented to modify the variation in volume of the working chamber of an ordinary engine, particularly to change the compression ratio in response to pressure within the combustion chamber. Such a device is disclosed in U.S. Pat. No. 4,137,873. The flexible head of the piston is joined directly, or through a Belleville spring, to the cylindrical side walls of the piston. During combustion, the top of the piston is deformed and thereby increases the volume of the combustion chamber in response to the pressure of gases within the combustion chamber. If the flexible top of the piston is designed to resist the mechanical and thermal stresses, then its elastic deformation during combustion is likely to be negligible, providing only a small additional increase in the working chamber volume. This will be most probably insufficient to create a noticeable influence on the combustion process. The same observations apply to Belleville springs. In addition, joining the top of the piston with the piston sidewalls is likely to be difficult and unreliable. Moreover, the radial deformation of the top portion of the piston may not suitably be controllable.

The previous observations also apply to the device disclosed in U.S. Pat. No. 4,359,976. In addition, the spiral coil spring cannot accept such big mechanical loads.

In the devices disclosed in U.S. Pat. No. 4,510,895 and U.S. Pat. No. 2,323,742, it is very likely that the plate or coil springs cannot accept the mechanical loads which originate in the combustion chamber.

SUMMARY OF THE INVENTION

A first object of this invention is to state a method of operating an internal combustion engine to optimize the variation law of the working chamber's volume in the vicinity of the piston top dead center (t.d.c.) position, so as to partially transform the combustion into a substantially isobaric process. This is obtained by means of a piston assembly with a variable geometry in which the height of the piston varies according to existing conditions within the combustion chamber. This specific construction of the piston assembly embodying the present invention, produces a combustion chamber having a much greater volume when the piston is located in the vicinity of its t.d.c. position when compared to that of a customary engine with the same compression ratio.

More particularly, the object of the present invention is to provide a method of operating an internal combustion engine during a combustion process, the engine having at least one cylinder and an associated piston for forming a working chamber in which intake, compression, combustion, expansion and exhaust operational events occur as the result of piston movement, the piston comprising (1) an upper portion having a working face defining a movable wall of the working chamber, (2) a lower portion having means for connection with a motor mechanism and (3) an elastic means for resiliently connecting the upper portion with the lower portion, the lower portion being operatively connected to the motor mechanism for moving the piston during the operational events and thereby generally increasing the working chamber in volume during the combustion, the method comprising:

(A) initiating the combustion of a combustible charge inside of the working chamber in the vicinity of piston top dead center position for generating a relatively abrupt initial increase in the gas pressure;

(B) additionally increasing the working chamber in volume by deforming the corresponding elastic means because of the initial increase of the gas pressure and thereby producing a relative movement of the upper portion with reference to the lower portion; and (C) controlling the increase of the working chamber in volume by a predeterminate deformation of the corresponding elastic means to brake the initial increase of the gas pressure within the combustion chamber and at least partially to replace it by a substantially isobaric combustion.

In the first phase, towards the end of the compression stroke, after the fuel ignition/autoignition, because of the gaseous pressure which acts on the piston, the elastic structure is compressed, thereby accumulating an energy of deformation. In this way, the piston crown approaches the skirt, decreasing the piston height and simultaneously increasing the volume of the combustion chamber. Subsequently, in a second phase, when the crank mechanism forces the piston to move downwardly, the piston crown has a second opposite movement which is superimposed and combined with the first one, until the elastic structure comes back to the initial, undeformed shape. At the same time, the mechanical energy stored in the elastic structure is, for the most part, given back to the working fluid under the form of an additional pressure which also aids in maintaining and lengthening an quasi-isobaric process within the working chamber. By varying the volume of the working chamber in this manner, any combustion can be turned into a process which is characteristic for a Diesel cycle.

This essentially constant pressure process is important since it constitutes the basis for improvement of the efficiency of an engine incorporating this invention as compared with Otto and Diesel engines using conventional piston configurations. A number of advantages can be realized by adopting this method:

1. The improvement in efficiency for an engine embodying the invention is due to the modification of the Otto and dual combustion operating cycles into an essentially Diesel cycle through:
   a. an adequate increase of the compression and expansion ratio without a necessary increase of the maximum pressure of the cycle;
   b. the combustion is partially changed into a quasi-isobaric process;
   c. the heat losses are diminished, especially during combustion when they are highest, because of an improved ratio "combustion chamber volume/heat transfer surface".
2. The shock waves are dampened during violent combustion.
3. The ignition/autoignition of the fuel is facilitated, particularly in the case of Otto engines.
4. The thermal insulation of the combustion chamber walls is facilitated by the present invention.
5. The most diverse fuels can be used without constructive changes.
6. The pollutant content of the exhaust is diminished.

A non restrictive description of preferred embodiments will now be given with reference to the appended drawings.

BRIEF DESCRIPTION OF THE DRAWINGS

FIGS. 2(*a, b*) are schematic representations of the upper portion of an internal combustion engine incorporating the present invention;

SPECIFIC DESCRIPTION

With reference to the drawings, FIG. 2 is a schematic cross section view in the upper part of an internal combustion engine having a reciprocating piston 21 fitted within a cylinder 1 so that, as it reciprocates, it defines a variable volume working chamber (and alternatively referred to as a combustion chamber 16) between the top of the piston and the closed end of the cylinder.

Figure 5:
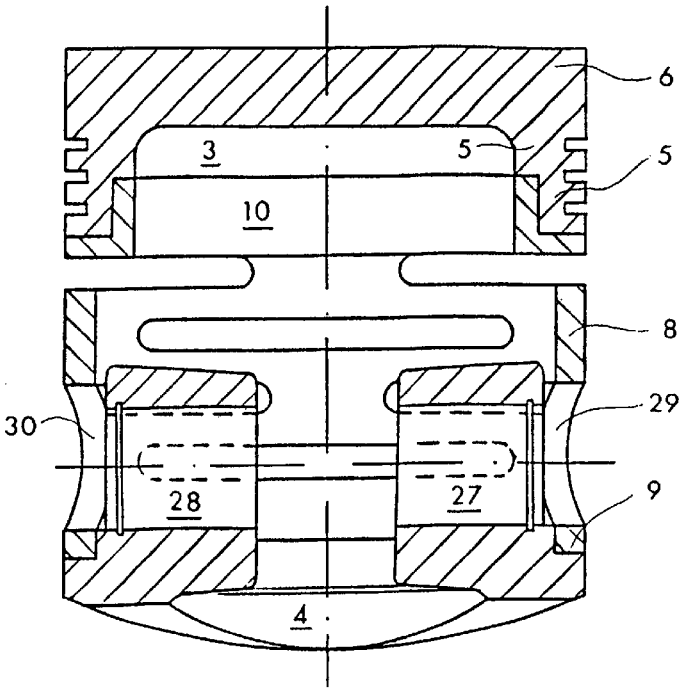
FIG. 5 is a front section view of the first embodiment of the invention as adapted for the substitution of the piston skirt by the elastic structure.
Figure 6:
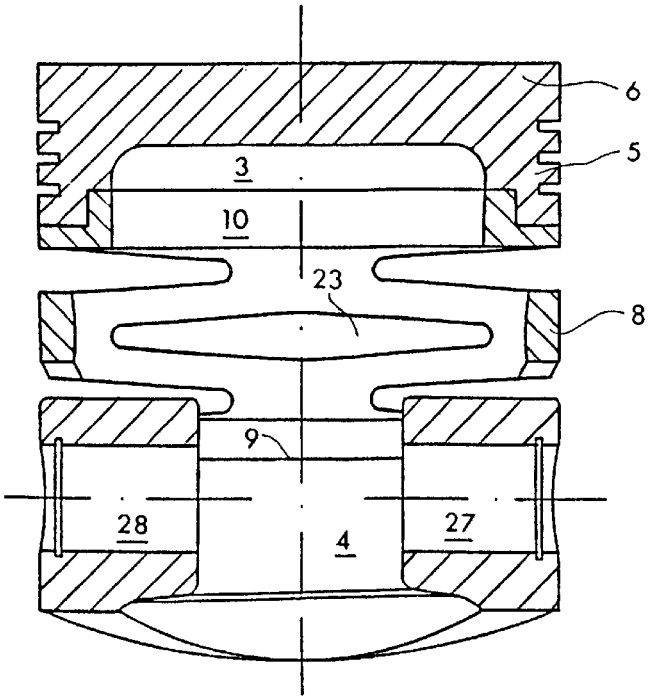
FIG. 6 is a front section view showing the second embodiment as adapted for the partial substitution of the piston skirt by the elastic structure.
Figure 7:
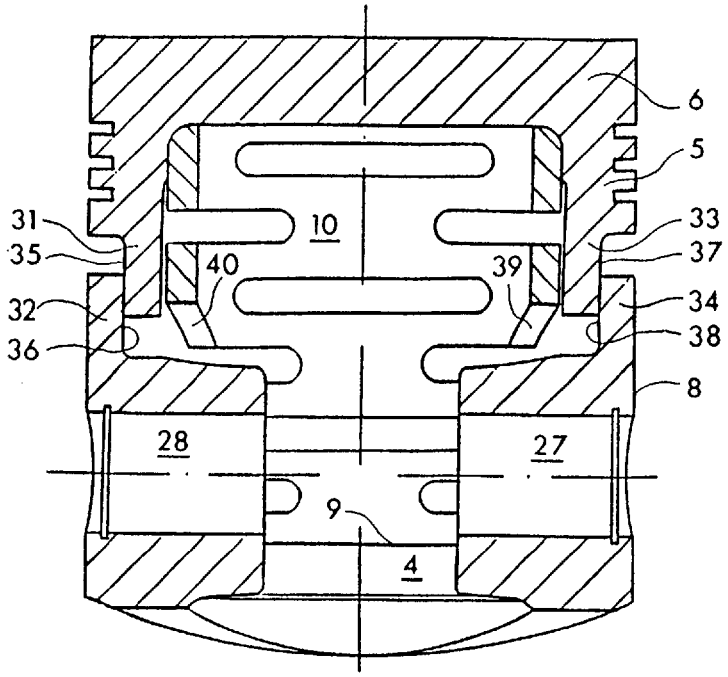
FIGS. 7 and 8 are front and side section views of the third embodiment of the invention having a pre-compressed elastic structure.
Figure 8:
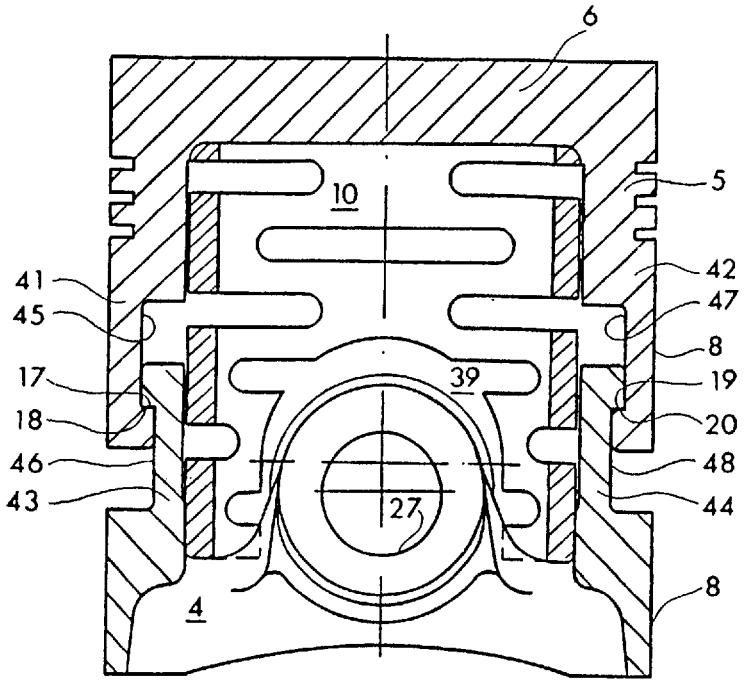

The engine may be in two or four stroke cycle, naturally aspirated, supercharged, carburetted or fuel injected, spark ignited or autoignited, or any other combination of the foregoing, operable over a working cycle including intake, compression/combustion and exhaust events. The specific piston constructed according to the present invention comprises an upper portion 3 including a crown 5 with seal rings 7 and a lower portion 4 including a skirt 8 with wrist pin bearings 27 and 28 as shown in FIGS. 5, 6, 7. The upper and lower portions are resiliently connected by an elastic structure 10 fitted between a top wall 6 of the crown 5 and an inward step 9 of the skirt 8. The elastic structure 10 may be uncompressed as shown in FIGS. 2*a*, 5, 6 or pre-compressed, installed by means of retainers 17 with 18 and 19 with 20, as shown in FIGS. 2*b*, 7, 8. The pre-compression force of the elastic structure 10 may be for example, comparable with the cylinder gas pressure force which acts on the piston 21 towards the end of the compression stroke.

The piston 21 is connected to an output crankshaft by a connecting rod 12 and reciprocates between a top and a bottom dead center positions (t.d.c. and b.d.c.) during the cyclic operational events of the engine, all in accordance with well-known principles. Intake and exhaust valves 14 and 15 allow the exchange of gases between cylinder and surroundings, and the spark plug 13 provides the ignition spark, if necessary.

Figure 1:
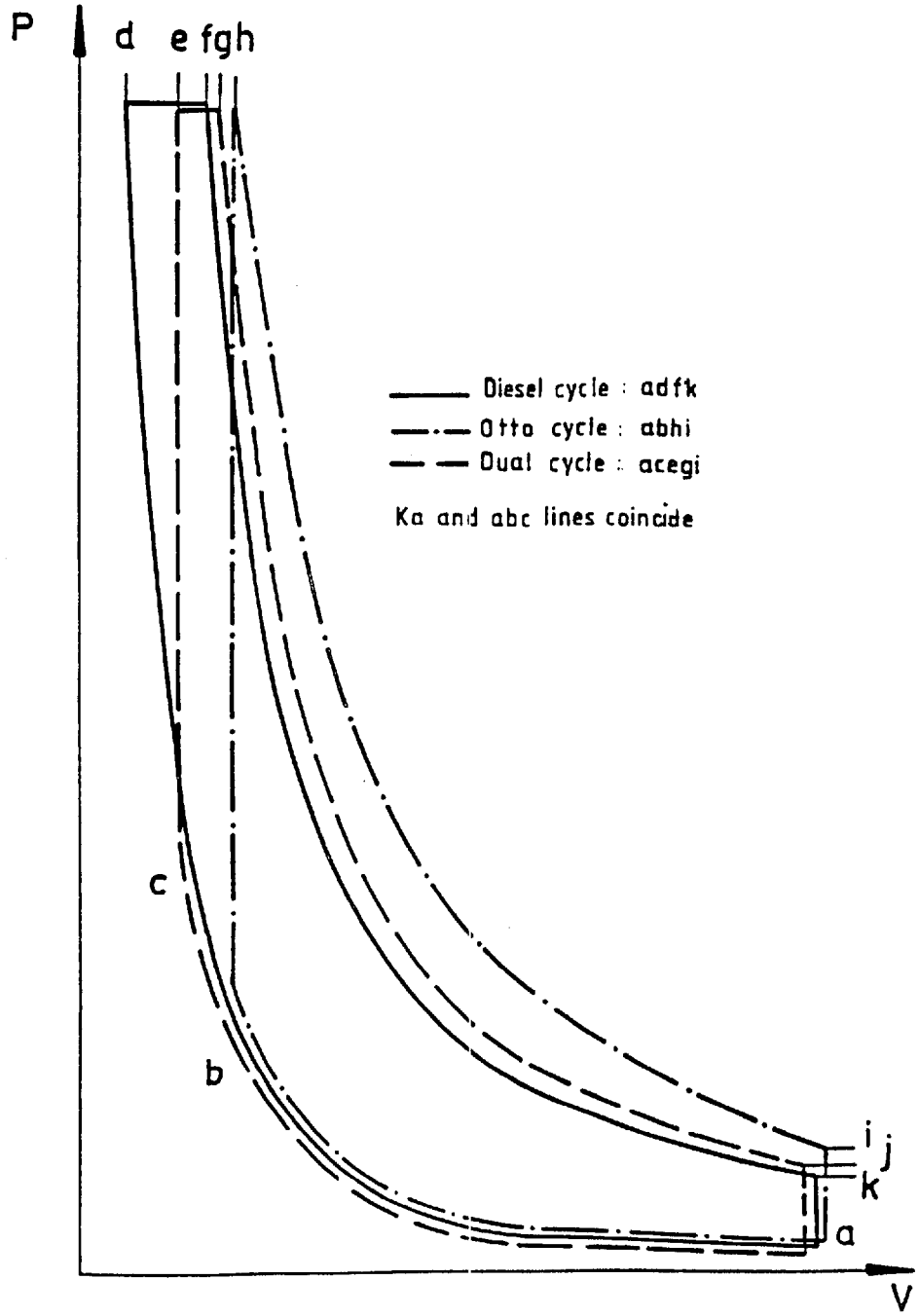
FIG. 1 shows the Diesel, dual combustion and Otto thermodynamic cycles which are superimposed for the same maximum pressure and work done.
Figure 3A:
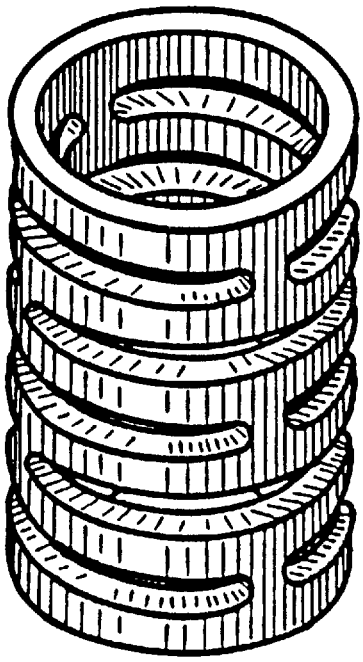
FIGS. 3(*a–d*) (X, Y, Z) show several configurations of an elastic structure which originates in a thick walled cylinder.
Figure 3B:
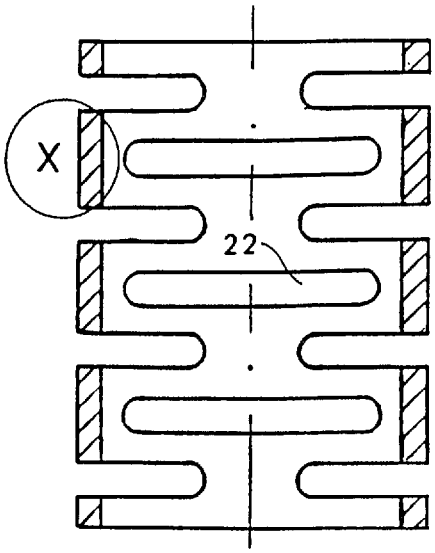
Figure 3X:
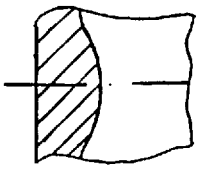
Figure 3Y:
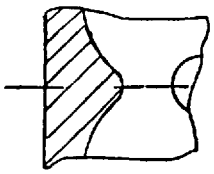
Figure 3Z:
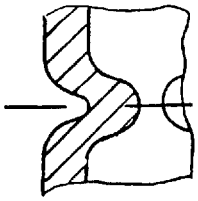
Figure 3C:
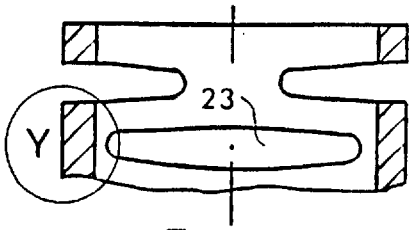
Figure 3D:
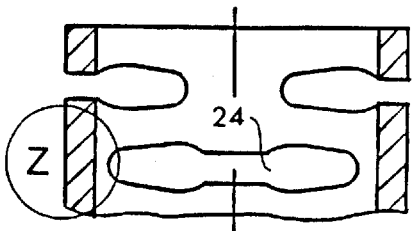
Figure 4:
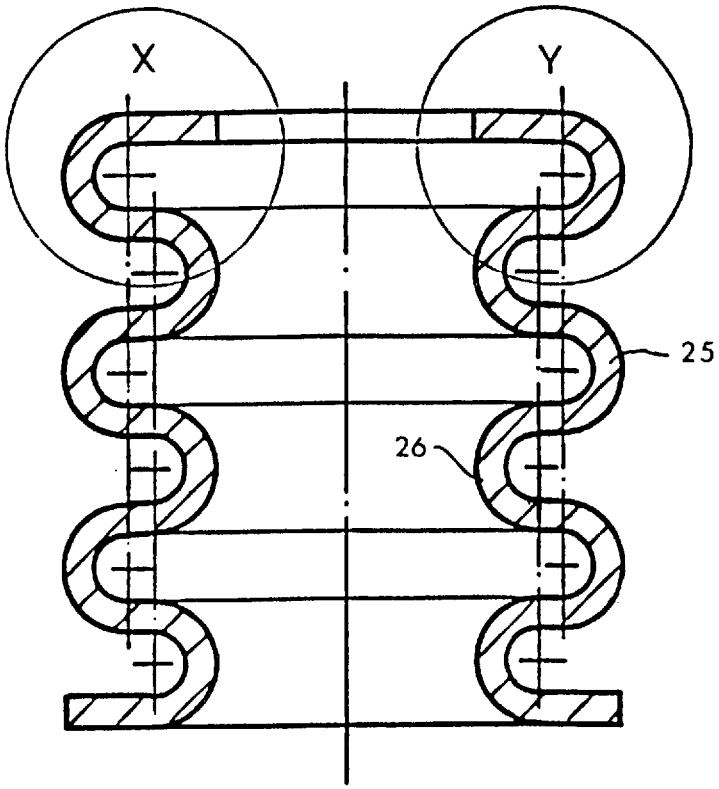
FIGS. 4, 4*x*, 4*y* show several configurations of an elastic structure which originates in a corrugated cylinder.

FIGS. 3 and 4 illustrate a few geometric configurations for the elastic structure 10. As is shown in FIGS. 3*a*, 3*b*, 3*c*, and 3*d*, the elastic structure 10 is configured as a slotted cylinder having cuts out bands of various shapes, dimensions and distributions on the cylinder side walls.

Figure 4X:
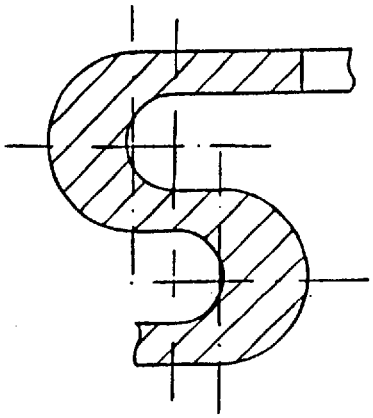
Figure 4Y:
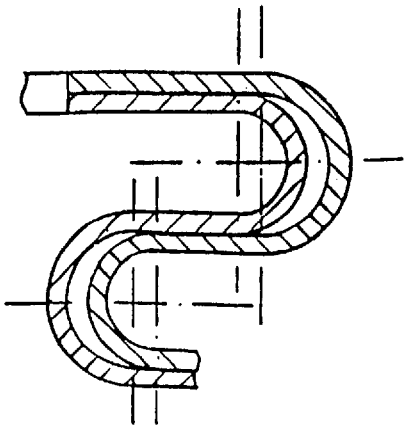

As is shown in FIG. 4, the elastic structure 10 is configured as a cylinder with corrugated walls under the form of toroidal surfaces 25, 26 which are ordered along their vertical axis, so that they successively change their concavity, or, as shown in FIG. 4Y, various combinations of them, ordered around their radial axis. By virtue of these possible configurations, the elastic structure 10 exhibits adequate elastic properties in its axial direction.

During engine operation, the piston 21 is subjected to a combination of vertical forces that include the cylinder gas pressure and the inertial forces. As a result, the net vertical force deflects the elastic structure 10 generating a major stress inside the material. Taking into account the requirements for a low mass, a high capacity to support the stress and a sufficient magnitude for the axial deflection, the elastic structure 10 is specially designed with a variable wall thickness so as to achieve a nearly uniform distribution of stress inside the material. By varying the wall thickness in this manner, the cylinder walls can have various profiles as shown in FIGS. 3X, 3Y, 3Z and in FIG. 4X in order to optimally use the material. The determination of such profiles for the cylinder side walls is made in accordance with a known mathematical routine.

A very useful effect is obtained by implementing a higher initial tension inside the elastic structure 10, namely leaving in it a residual stress of the opposite sign to the subsequently applied stress, thus reducing the final maximum stress produced by the application of the working load and improving its durability. The effect is to raise the apparent elastic limit of the elastic structure 10. FIGS. 5 through 8 illustrate several embodiments incorporating the features of this method.

FIG. 5 shows a first embodiment of the method under discussion. This arrangement is characterized by the installation of the elastic structure 10 between the piston crown 5 and the bottom part of the piston. Another characteristic of this arrangement is that the elastic structure substitutes for the piston skirt 8. Accordingly, the lower part 4 of the piston 21, in this configuration is the structure capable of transmitting the mechanical effort to the pin bearings 27 and 28 which are designed to be recessed inside the elastic structure 10. In addition, the elastic structure 10 can have two circular cut-outs 29 and 30 around the pin bearings to facilitate the access to the wrist pin.

FIG. 6 shows a second embodiment of the present method. In this arrangement, the elastic structure 10 is partially substituting for the piston skirt 8 in the middle part of the piston 21. A specific characteristic for this arrangement is the reduced height of the elastic structure and its geometric details (cut-outs 23) which provide a greater axial deflection.

FIGS. 7 and 8 show a third embodiment of the present method where the elastic structure is pre-compressed. The front view shown in FIG. 8 is orthogonal to the view of FIG. 7. In this arrangement, the elastic structure 10 is fitted within the piston between the top wall 6 of the crown 5 and an annular rabbet 9 located within the base of the piston skirt 8. The elastic structure 10, one of the previously described types, FIGS. 3 and 4, has two additional cut-outs 39 and 40 around the pin bearings 27 and 28, respectively.

Four semicylindrical walls are located in the lower part of the piston crown 5, arranged in pairs, namely 31, 33 and 41, 42, possessing outer surfaces 35,37 and inner surfaces 45,47 respectively; the inner surfaces terminating at the lower end of the specified walls in two semicircular inner steps 17 and 19. The piston skirt 8 has also four semicylindrical walls which are complementary with those above-mentioned, located in the upper part of the skirt and also arranged in pairs, namely 32, 34 and 43, 44, possessing inner surfaces 36, 38 and outer surfaces 46, 48 respectively; the outer surfaces terminate in two semicircular inner steps 18 and 20.

The connection between skirt and crown is made by way of conjugated surfaces which slide-fit together. The conjugated semicircular steps are fitted together, namely 17 with 18 and 19 with 20, in such a way as to limit the amount of movement of the crown in relation to the piston skirt and simultaneously interact with the elastic structure 10 to load it with a predetermined tension. According to the present invention, this method can be applied to any internal combustion engine that operates using a working space of variable size generated by a piston and a motor mechanism movement.

The principle of the method and operation of the piston assembly are described with reference to FIGS. 2*a*, 5, 6, 9*a*, 10, 11, 12 and 2*b*, 7, 8, 9*b*, 10 in the case of an uncompressed and a pre-compressed elastic structure 10, respectively.

Figure 10:
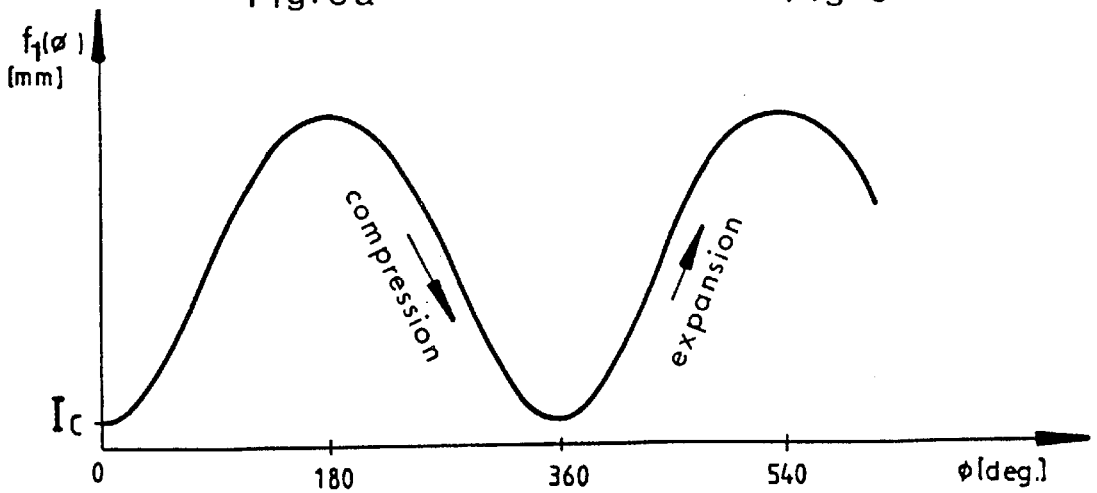
FIG. 10 is a graphical representation of the piston displacement govern by the crank mechanism movement, described by a function $f_1(\phi)$.

FIG. 10 illustrates the piston displacement caused by the crank mechanism versus crankshaft angle, wherein the piston path is described by a movement function $f_1(\phi)$ and where $I_c$ represents the equivalent height of the combustion chamber for both the customary and inventive engine. In operation, as the piston 21 moves in the direction of the cylinder head, the air/fuel mixture is compressed and, before t.d.c. position of the piston, the fuel is ignited by the aid of the spark plug 13 or the high temperature of the compressed air. When the combustion has been initiated, the pressure and temperature rapidly increase and generate the thrust necessary to produce the power stroke of the piston.

In the case of an engine embodying the present invention, the shock wave and the flame front that propagate to the piston head act on the piston crown and abruptly deform the elastic structure 10. The pressure shock wave that precedes the flame front is absorbed and attenuated by the elastic structure 10. As a result, the piston crown 5 moves downwards, abruptly increasing the volume of the combustion chamber 16. The abrupt increase in volume of the combustion chamber 16 creates a greater space for the combustion, and simultaneously generates microturbulences which improve the quality and efficiency of combustion, diminishing the undesirable emissions.

Most of the heat transferred to the walls occurs just before, during and after the combustion process in the vicinity of the piston t.d.c. position. In the case of the present invention the heat losses are diminished because of the optimization of the ratio between the combustion chamber volume and the heat transfer surface.

Figure 9A:
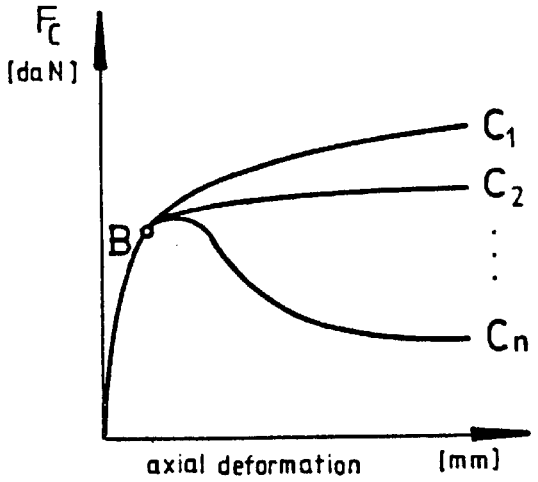
FIGS. 9(*a, b*) are graphical representations showing the correlation between the compression force (the load) against deflection for several configurations of the elastic structure, in an uncompressed and a pre-compressed state.
Figure 9B:
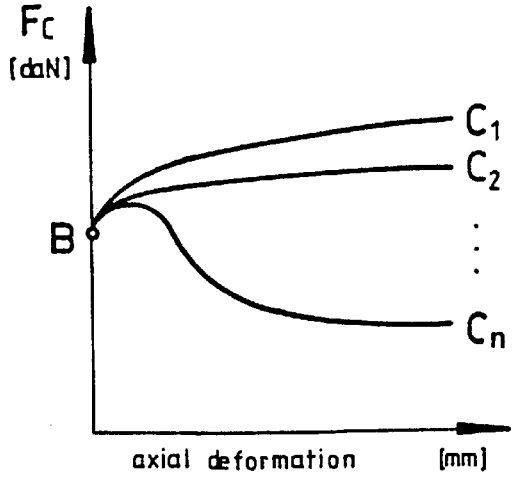
Figure 11:
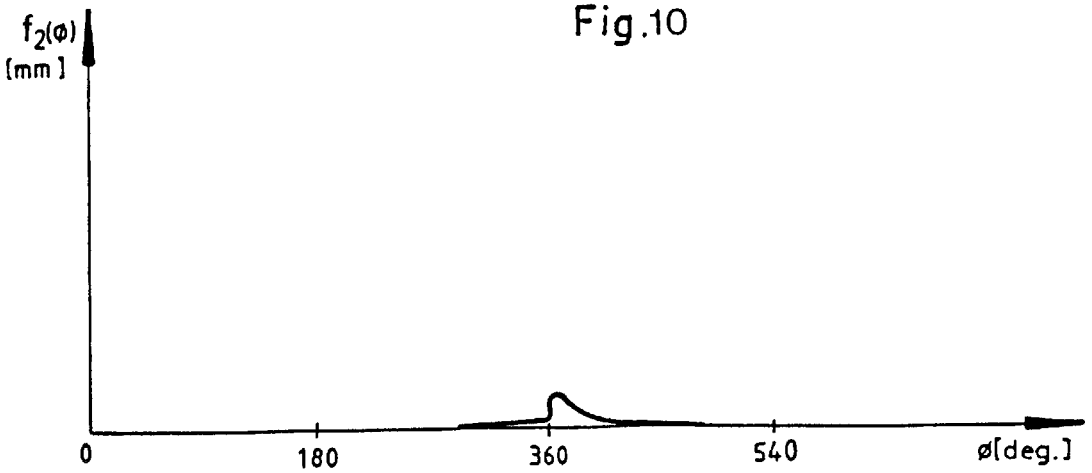
FIG. 11 is a graphical representation of the height of the piston against the crank angle, described by a function $f_2(\phi)$.

As shown in FIG. 9, curves $C_1, C_2, \ldots, C_n$ illustrate the relationship between the load $F_c$ (compression force yielded by the cylinder gases pressure) and deflection rate, in the case of a number "n" of elastic structures 10. Each curve is characteristic for a specific configuration of the elastic structure. FIGS. 9*a* and 9*b* show the same possible elastic characteristics $C_1, C_2, \ldots, C_n$ on an uncompressed and pre-compressed elastic structure, respectively. An elastic characteristic represented in co-ordinate deflection rate against crankshaft angle as shown FIG.11, illustrates in fact, the piston crown 5 displacement related to piston skirt 8, described by a function $f_2(\phi)$. Therefore, in the vicinity of the t.d.c. position, the piston crown 5 is submitted to a compound movement, expressed by the relation:

$$f(\phi)=f_1(\phi)+f_2(\phi)$$

where:

$f(\phi)$—is a function which describes the compound movement of the piston crown in the vicinity of the t.d.c.;

$f_1(\phi)$—is a function which describes the displacement of the piston crown due to crank mechanism movement;

$f_2(\phi)$—is a function which describes the displacement of the piston crown due to axial deformation of the elastic structure.

The combined movement of the piston crown determines a corresponding modification in the variation of the volume of the combustion chamber, according to the relation:

$$F(\phi)=F_1(\phi)+F_2(\phi)$$

where:

$F(\phi)$, $F_1(\phi)$ and $F_2(\phi)$ came from movement functions $f(\phi)$, $f_1(\phi)$ and $f_2(\phi)$ which are multiplied by the cross-sectional surface area of the cylinder 1 in which the piston reciprocates;

$F(\phi)$—is a function which describes the volume variation of the combustion chamber in the vicinity of the piston t.d.c. position;

$F_1(\phi)$—is a function which describes the volume variation of the combustion chamber due to crank mechanism action;

$F_2(\phi)$—is a function which describes the volume variation of the combustion chamber due to deformation of the elastic structure of the piston.

Figure 12:
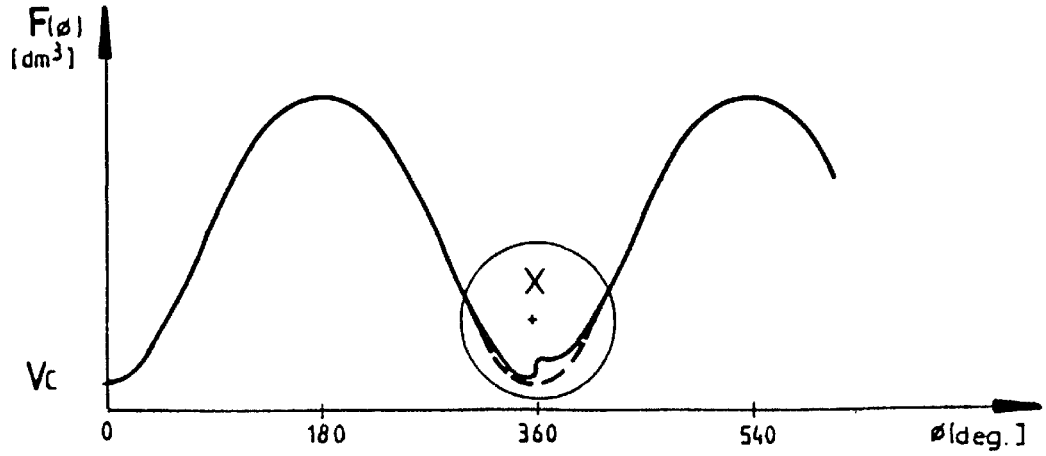
FIG. 12 and 12X show the resultant variation in volume of the combustion chamber both in the case of an engine incorporating this invention and a comparison engine.

FIG. 12 illustrates the relationship between the working volume of cylinder 1 and the crankshaft angle, especially in the vicinity of the piston t.d.c. position, wherein the solid lines apply to the inventive engine and the broken lines apply to a customary engine.

Figure 12X:
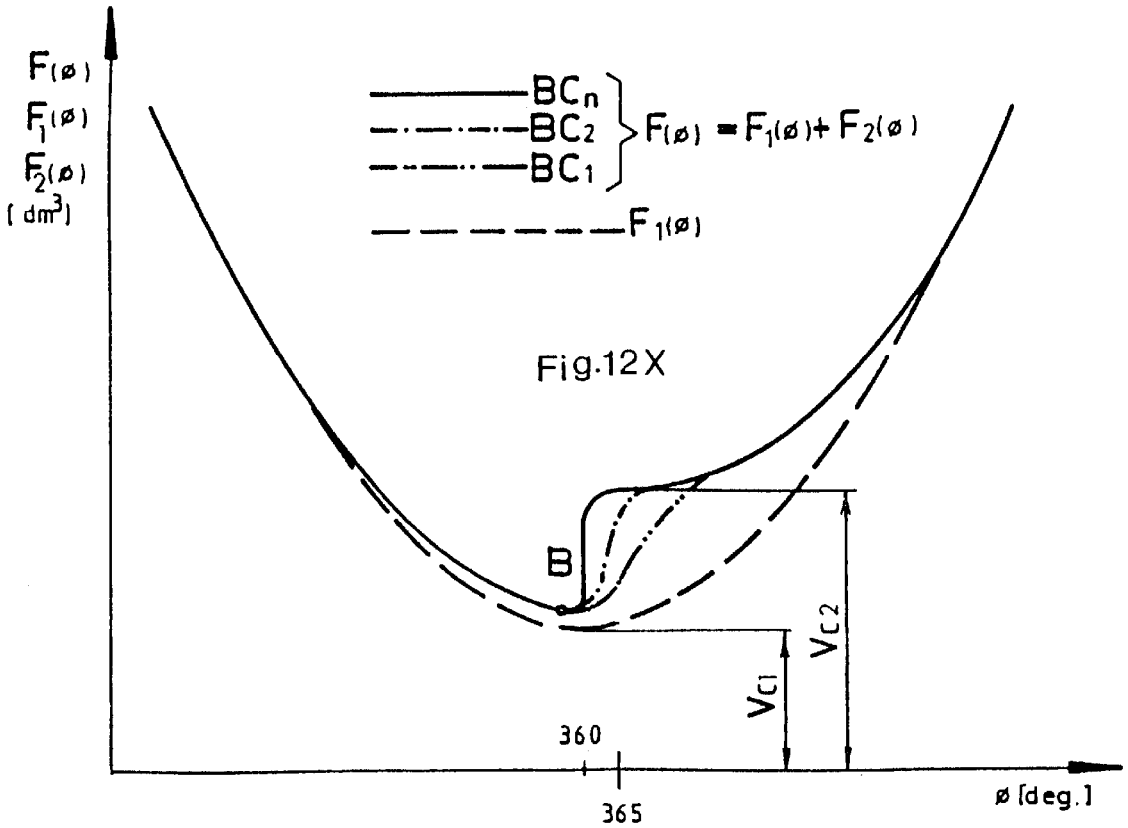

More specifically, as a result of the cylinder gas pressure force acting on the piston crown 5, the elastic structure is deformed and the volume of the combustion chamber 16 is abruptly and substantially increased. In the case of two similar engines having the same compression ratio, in the piston t.d.c. position ($\phi$=360 deg) as shown in FIG. 12X, for the inventive engine the volume $V_{c2}$ of the combustion chamber is much greater than the volume $V_{c1}$, of the same chamber in the case of the comparison engine. The result is that the peak pressures are attenuated and at at least partially replaced by a substantially isobaric process. As is known in the field, for the same work done and maximum pressure, the cycles with a constant pressure combustion are more efficient than the corresponding dual combustion and Otto cycles.

The combustion process is essentially influenced by the elastic characteristics $BC_1$, $BC_2$, . . . , $BC_n$ resulting from various configurations of the elastic structure 10. As shown in FIG. 12X, due to the above-mentioned elastic characteristics, the increase in the volume of the combustion chamber can be varied over a wide range, so as to optimally suit the operational cycle requirements.

The increase of the compression ratio does not necessarily increase the maximum pressure of the cycle. As is known, both a higher compression and expansion ratio improve the engine efficiency, and higher temperatures towards the end of the compression facilitate ignition and autoignition of the fuel and particularly decrease the strength and delay at autoignition in the case of Otto engines. The mechanical energy provided by the abrupt increase in volume of the combustion chamber is accumulated in the elastic structure 10 through its elastic deformation. When the expansion begins, the crank mechanism determines the increase in the combustion chamber volume while the piston crown has an opposite movement due to the elastic structure. The elastic structure expands and this counteracts the increase in the combustion chamber volume. The mechanical energy stored in the elastic structure is transferred to the working fluid in the form of an additional pressure which also has the tendency to maintain a quasi-constant pressure within the combustion chamber.

The smooth combustion process at a nearly steady pressure allows the thermal insulation of the combustion chamber walls to limit the thermal losses.

In the case of Diesel engines, this invention allows the homogenization of the air/fuel mixture. Even if the ignition appears to occur instantaneously in multiple points throughout the combustion chamber, due to its rapid increase in volume, the pressure peaks and shock waves are absorbed and eliminated. The ignition and the combustion of each charge produce periodic vibrational shock waves within the combustion chamber. In accordance with the present method, it is desirable that for a short period of time, to the end of the compression, the piston head be in resonance with the pressure waves and use their energy to improve the combustion process.

In the case of FIGS. 2*b*, 7 and 8, the elastic structure is pre-compressed by an initial, predetermined load. The advantage of a pre-loaded elastic structure is a more stable operation using only the useful portion of the elastic characteristic to decrease the losses of energy during deformation due to the mechanical hysteresis loop of the material.

In summary, the combustion process is defined by the pressure and temperature rate and also by the variation law of the volume of the combustion chamber. As a result of this method, the combustion process and the piston movement are optimally synchronized.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A method of operating an internal combustion engine during a combustion process, the engine having at least one cylinder and an associated piston for forming a working chamber in which intake, compression, combustion, expansion and exhaust operational events occur as the result of piston movement, the piston comprising (1) an upper portion having a working face defining a movable wall of the working chamber, (2) a lower portion having means for connection with a motor mechanism and (3) an elastic means for resiliently connecting the upper portion with the lower portion, the lower portion being operatively connected to the motor mechanism for moving the piston during the operational events and thereby generally increasing the working chamber in volume during the combustion, the method comprising:

(A) initiating the combustion of a combustible charge inside of the working chamber in the vicinity of piston top dead center position for generating a relatively abrupt initial increase in the gas pressure;

(B) additionally increasing the working chamber in volume by deforming the corresponding elastic means because of the initial increase of the gas pressure and thereby producing a relative movement of the upper portion with reference to the lower portion; and (C) controlling the increase of the working chamber in volume by a predeterminate deformation of the corresponding elastic means to brake the initial increase of the gas pressure within the combustion chamber and at least partially to replace it by a substantially isobaric combustion.

2. A method according to claim 1, wherein the elastic means comprises at least one generally cylindrical elastic structure.

3. A method according to claim 2, wherein the elastic structure is slotted.

4. A method according to claim 2, wherein the elastic structure is corrugated.

5. A method according to claim 1, wherein the elastic means comprises an elastic structure having at least one portion shaped for an uniform distribution of tension therein.

6. A method according to claim 1, wherein the elastic means comprises an elastic structure having no portion shaped for an uniform distribution of tension therein.

7. A method according to claim 1, wherein the elastic means comprises an elastic structure having at least one pre-stressed portion.

8. A method according to claim 1, wherein the elastic means comprises an elastic structure having no pre-stressed portion.

* * * * *